US007699142B1

(12) United States Patent
Wurth et al.

(10) Patent No.: US 7,699,142 B1
(45) Date of Patent: Apr. 20, 2010

(54) DIAGNOSTIC SYSTEM HAVING USER DEFINED SEQUENCE LOGIC MAP FOR A TRANSPORTATION DEVICE

(75) Inventors: Steven P. Wurth, Sylvania, OH (US); Stephen W. Pratt, Lambertville, MI (US); Daniel C. Bryant, Elgin, TX (US)

(73) Assignee: Wurtec Elevator Products & Services, Toledo, OH (US)

( * ) Notice: Subject to any disclaimer, the term of this patent is extended or adjusted under 35 U.S.C. 154(b) by 419 days.

(21) Appl. No.: 11/803,048

(22) Filed: May 11, 2007

Related U.S. Application Data

(60) Provisional application No. 60/799,867, filed on May 12, 2006.

(51) Int. Cl.
*B66B 1/34* (2006.01)

(52) U.S. Cl. ..... 187/391; 187/247

(58) Field of Classification Search ..... 187/247, 187/248, 391–393
See application file for complete search history.

(56) References Cited

U.S. PATENT DOCUMENTS 3,973,648 A 8/1976 Hummert et al.
4,418,795 A * 12/1983 Trosky et al. ..... 187/391
4,491,198 A 1/1985 Noda et al.
4,512,442 A 4/1985 Moore et al.
4,568,909 A 2/1986 Whynacht
4,622,538 A 11/1986 Whynacht et al.
4,698,780 A 10/1987 Mandel et al.
4,750,591 A 6/1988 Coste et al.
4,771,865 A 9/1988 Hinderling
4,823,914 A 4/1989 McKenney et al.
4,898,263 A 2/1990 Manske et al.
4,930,604 A 6/1990 Schienda et al.
4,958,707 A 9/1990 Yoneda et al.
5,007,506 A 4/1991 Suzuki et al.
5,042,620 A 8/1991 Yoneda et al.
5,064,026 A 11/1991 Nagata et al.
5,162,623 A 11/1992 Tachino
5,254,813 A 10/1993 Hirashiki
5,382,943 A 1/1995 Tanaka
5,392,879 A 2/1995 Boyce et al.
5,398,782 A 3/1995 Talbot et al.
5,431,252 A * 7/1995 Morrison ..... 187/394
5,445,245 A 8/1995 Ketoviita
5,554,832 A 9/1996 Lumme et al.
5,557,546 A 9/1996 Fukai et al.
5,588,038 A 12/1996 Snyder
5,708,416 A 1/1998 Zaharia et al.

(Continued)

FOREIGN PATENT DOCUMENTS

JP 2002020049 1/2002

(Continued)

*Primary Examiner*—Jonathan Salata
(74) *Attorney, Agent, or Firm*—MacMillan, Sobanski & Todd, LLC

(57) ABSTRACT

A diagnostic system for a transportation device includes an analyzer unit. The analyzer unit includes a user defined sequence logic map. The sequence logic map defines a sequence for a plurality of name inputs. The analyzer unit is configured to monitor the operating condition of the plurality of named inputs and compare the operating condition of the plurality of named inputs with the user defined sequence logic map. The analyzer unit communicates the comparison in a notification.

20 Claims, 5 Drawing Sheets

U.S. PATENT DOCUMENTS 5,714,726 A 2/1998 Ketoviita
5,736,692 A 4/1998 Lumme et al.
5,787,020 A 7/1998 Molliere et al.
5,817,994 A 10/1998 Fried et al.
5,889,239 A 3/1999 Blackaby et al.
6,006,171 A 12/1999 Vines et al.
6,067,477 A 5/2000 Wewalaarachchi et al.
6,109,396 A 8/2000 Sirag et al.
6,119,125 A 9/2000 Gloudeman et al.
6,304,257 B1 10/2001 Viskari
6,330,935 B1 * 12/2001 Systermans ..... 187/391
6,330,936 B1 12/2001 Lence Barreiro et al.
6,381,506 B1 4/2002 Grappone
6,389,335 B1 5/2002 Vos
6,462,654 B1 10/2002 Sandelman et al.
6,471,014 B1 10/2002 Daniel et al.
6,477,434 B1 11/2002 Wewalaarachchi et al.
6,494,296 B2 12/2002 Lindegger et al.
6,497,306 B2 12/2002 Mori et al.
6,516,923 B2 2/2003 Lence Barreiro et al.
6,526,368 B1 2/2003 Coste et al.
6,543,583 B1 4/2003 Lence Barreiro et al.
6,550,585 B2 4/2003 Schoppa et al.
6,604,611 B2 8/2003 Liu et al.
6,684,055 B1 1/2004 Blackaby
6,823,291 B2 11/2004 Marsland
6,863,161 B2 3/2005 Mearns
6,922,558 B2 7/2005 Delp
6,986,408 B2 1/2006 Takeuchi
6,998,995 B2 2/2006 Nakajima
7,002,462 B2 2/2006 Welch
7,004,289 B2 * 2/2006 Shrum et al. ..... 187/393
7,073,633 B2 7/2006 Weinberger et al.
7,172,055 B2 2/2007 Engel et al.
2003/0000777 A1 1/2003 Lence Barreiro et al.
2003/0067387 A1 4/2003 Kwon et al.

FOREIGN PATENT DOCUMENTS

WO WO02064479 8/2002

* cited by examiner

DIAGNOSTIC SYSTEM HAVING USER DEFINED SEQUENCE LOGIC MAP FOR A TRANSPORTATION DEVICE

CROSS REFERENCE TO RELATED APPLICATIONS

This application claims the benefit of U.S. Provisional Application No. 60/799,867, filed May 12, 2006, the disclosure of which is incorporated herein by reference.

BACKGROUND OF THE INVENTION

This invention relates to monitoring systems for elevators, escalators, moving walks, and similar devices. In particular, this invention relates to a system for remotely monitoring and diagnosing the operation and status of a single elevator or a group of elevators, escalators, moving walks, or the like.

Elevators, escalators, moving walks, and similar devices are relied upon by building owners and the public to provide reliable and safe operation to move people and supplies. A malfunction by an elevator, escalator, moving walk, or similar device can result in immediate inconvenience to the riders. Further, malfunctions can result in unanticipated repair costs incurred by building owners, the loss of value to buildings, and the loss of prospective or existing building tenants. Often, malfunctions may be short lived problems that are easily identified, diagnosed, and resolved. However, some malfunctions are not easily diagnosed and identified. These malfunctions may be intermittent problems or problems that appear only for a brief period of time or under very specific conditions.

Malfunctions may occur due to the complexity and nature of the control systems for elevators, escalators, moving walks, and similar devices. Typically, control systems may include various electrical systems and components, including wiring, relays, resistors, terminals, contacts, sensors, etc. The control systems are configured for elevator functions, such as starting, stopping, communications, leveling, positioning, lighting, signaling, sensors, alarms, and the like. More modern control systems may also include microprocessor or computer-based systems for data acquisition, decision making, error analysis, scheduling maintenance tasks, communicating, and informational displays. Control systems may also include pumps, motors, clutches, selectors, brakes, motor-generator sets, verniers, silicon controlled rectifiers, belts, digital encoders, and sensors of all types, including optical and magnetic.

Malfunctions may also occur due to the age of the control equipment. While many elevator control systems have been modernized every 20 to 25 years with sophisticated computer based controls, many existing elevator control systems have not been modernized and are still functioning long after the useful life of the original control system has been exceeded. These obsolete control systems will incur malfunctions due to the age, brittleness, and obsolescence of the electrical controls.

When a malfunction occurs, service personnel are faced with diagnosing the problem or problems and implementing a timely repair. Diagnosing minor malfunctions can often be accomplished on-site through the experience and expertise of service personnel without the use of sophisticated or complex diagnostic equipment. However, many malfunctions cannot be diagnosed and corrected as easily. If the cause of the malfunction is not readily apparent or if the service personnel is not on-site to observe the cause of the malfunction, the diagnosis can be difficult and the resolution elusive.

Older control systems typically do not have diagnostic equipment incorporated with the control systems. More modern control systems often have diagnostic equipment incorporated within the control system to aid in the diagnostic effort. However, the diagnostic equipment incorporated within more modern control systems often provide limited information and only for pre-defined control circuits or control points. Additionally, modern control systems often provide information for other purposes, such as maintenance tasks, which do not assist the service personal in diagnosing and resolving malfunctions. When the control system does not have diagnostic equipment incorporated within the control system or the incorporated diagnostic does not have the capacity to address the malfunction, the service personnel may have difficulty diagnosing the malfunctions on a timely and efficient basis.

For all of these reasons, it would be advantageous to provide a diagnostic system that is capable of being easily adapted to all forms and vintages of elevators, escalators, moving walks, and other similar devices, and further that provides the user with many capabilities to monitor user selected circuits and control points to easily diagnose malfunctions.

SUMMARY OF THE INVENTION

This invention relates to a diagnostic system for a transportation device that includes an analyzer unit. The analyzer unit includes a user defined sequence logic map. The sequence logic map defines a sequence for a plurality of name inputs. The analyzer unit is configured to monitor the operating condition of the plurality of named inputs and compare the operating condition of the plurality of named inputs with the user defined sequence logic map. The analyzer unit communicates the comparison in a notification.

This invention also relates to a method for diagnosing control system malfunctions. The method includes the steps of: selecting and naming a plurality of control system points, providing an analyzer unit, the analyzer unit including a user defined sequence logic map defining a sequence for the plurality of named control system points, the analyzer unit being configured to monitor the operating condition of the plurality of named control system points and communicate the comparison in a notification, providing a host computer connected to the analyzer unit and configured to display the notification communicated by the analyzer unit, operating the control system, collecting actual sequence data from the plurality of named control system points, comparing the collected actual sequence data with the user defined sequence logic map, and communicating the results of the comparison in a notification to the host computer.

Various objects and advantages of this invention will become apparent to those skilled in the art from the following description of the preferred embodiments, when read in light of the accompanying drawings.

DETAILED DESCRIPTION OF THE PREFERRED EMBODIMENTS

Figure 1:
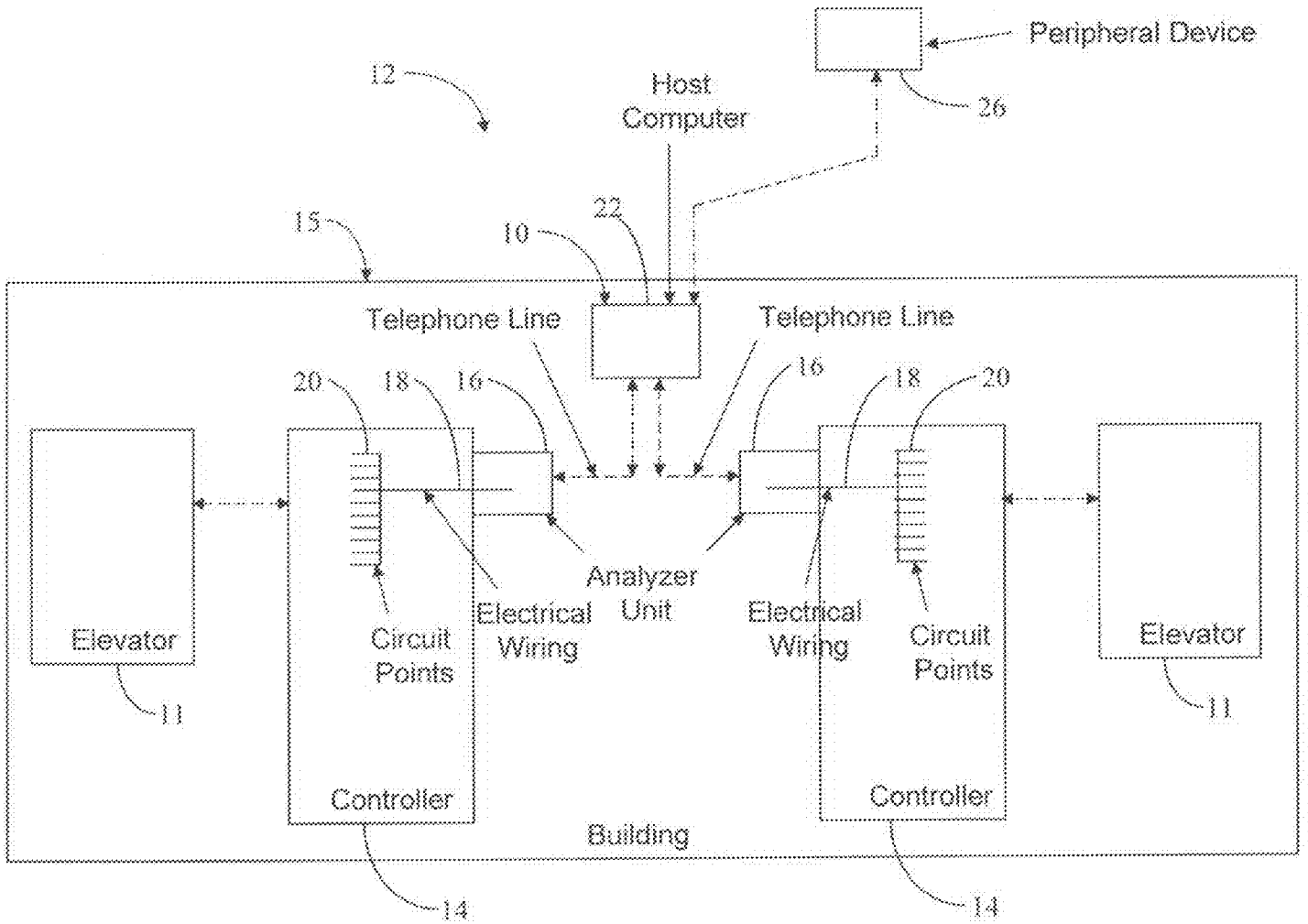
FIG. 1 is a schematic view of a pair of transportation device controllers provided with a diagnostic system in accordance with this invention.

Referring now to the drawings there is illustrated in FIG. 1 a first embodiment of a diagnostic system, indicated generally at 10, in accordance with this invention. As will be explained in detail below, the diagnostic system 10 is adapted to diagnose the operating condition of user selected control circuits and user selected control circuit points for transportation devices, such as elevators, escalators, moving walks, inclinators, man-lifts, dumbwaiters, or similar devices.

As shown generally in FIG. 1, a building 12 may be equipped with a vertical or horizontal transportation device 11. The operation of each transportation device 11 is controlled by a controller 14. The controllers 14 for the transportation devices 11 are located in mechanical rooms 15 within the building 12. While FIG. 1 illustrates a single mechanical room 15, it should be understood that a building 12 may contain a plurality of mechanical rooms 15. While the illustrated embodiment shown in FIG. 1 includes two controllers representing two transportation devices 11, it should be understood that a building 12 can contain any number of transportation devices 11, each having its own controller 14. A controller 14 contains the necessary electronic, electrical, and mechanical, components, circuits, and wiring to control the functions of the transportation device 11, including starting, stopping, acceleration, deceleration, velocity, leveling, and movement. The controller 14 also contains safety circuits that prevent the operation of the transportation device 11 unless the safety circuit indicates various safety devices are in a proper mode of operation. Optionally, a group of transportation devices 11 may coordinate by a separate controller (not shown) to control and coordinate the operation of all of the transportation devices 11 within the group.

As shown in FIG. 1, the diagnostic system 10 includes an analyzer unit 16 attached to each controller 14. The analyzer unit 16 contains various electronic and microprocessor equipment (not shown). Generally, the analyzer unit 16 collects, analyzes, and interprets data received from the controller 14.

The analyzer unit 16 is electrically connected to the controller 14 by electrical wiring 18. A first end of the electrical wiring 18 is connected to the analyzer unit 16 at input terminals (not shown) located within the analyzer unit 16. The second end of the electrical wiring 18 is connected to user selected circuit points 20 located within each controller 14. The user selected circuit points 20 can include any point in any circuit that can provide a voltage or a state condition (on/off or high/low for example). Examples of selected circuit points 20 include "car start" relays, "leveling" Sensors, and "over speed" contacts. The electrical wiring 18 is sized to correspond with the electrical voltage and current found in the selected circuit points 20.

In the illustrated embodiment, the selected circuit points 20 are located within the controller 14 and have been selected by the user of the diagnostic system 10 to diagnose a malfunction. In one embodiment, the selected circuit points 20 include any point in an electrical or electronic circuit having a measurable current or voltage. Alternatively, the selected circuit point 20 can be any device such as, for example, a pressure or temperature sensor, that generates a measurable signal. In this embodiment, the circuit points 20 can be located in another device associated with the transportation device, such as for example motors, motor-generator sets, governors, power supply panels, etc.

As previously mentioned, the analyzer unit 16 collects signals generated at the selected circuit points 20. In one embodiment, the signals generated at the selected circuit points 20 and collected by the analyzer unit 16 are analog signals. In another embodiment, the signals generated at the selected circuit points 20 and collected by the analyzer unit 16 are digital signals. In yet another embodiment, the signals at the selected circuit points 20 and collected by the analyzer unit 16 can be another type of signal sufficient to communicate the operating condition of the selected circuit point 20.

In the illustrated embodiment, the selected circuit points 20 are individually wired to the analyzer unit 16. In this embodiment, a maximum of sixteen circuit points 20 can be selected. In another embodiment, the circuit points 20 are wired to the analyzer unit 16 via wiring modules (not shown). In this embodiment, each module can accommodate up to sixteen circuit points and an unlimited number of modules can be used. In yet another embodiment, the selected circuit points 20 are wired to a communications bus (not shown). The communications bus is configured to communicate with desired analyzer units 16, thereby allowing specific analyzer units 16 to analyze pre-selected malfunctions.

As will be explained later in more detail, the selected circuit points 20 are named by the user of the diagnostic system 10. The user also pre-defines the operating conditions for each selected circuit point 20. As the transportation device operates, the analyzer unit 16 monitors the actual operating conditions of the selected circuit points 20 and compares the actual operating conditions with the pre-defined conditions. The results of the comparison can be sent via a notification to the user for further analysis.

As further shown in FIG. 1, the analyzer unit 16 communicates with a host computer 22. In the illustrated embodiment, the host computer 22 is a laptop-style computer. Alternatively, the host computer 22 can be any computer or device, such as for example a personal digital assistant, sufficient to communicate with the analyzer unit 16. In the illustrated embodiment, the host computer 22 is positioned near the controllers 14 to facilitate operation by the user. In another embodiment, the host computer 22 can be positioned in another location such as, for example, in another office within the building 12. In yet another embodiment, the host computer 22 can be positioned in another building (not shown). It should be understood that the location of the host computer 22 is not important to the operation of the diagnostic system 10.

The host computer 22 is configured to enable the host computer 22 to communicate with the analyzer unit 16 through a variety of communication means. In the illustrated embodiment, the host computer 22 is connected to the analyzer unit 16 by hard wire plug-in connection. Alternatively, the host computer 22 can communicate with the analyzer unit 16 by other methods, such as for example modem-based telephone line, cellular telephone, Ethernet, micro wave, radio and WiFi. In yet another embodiment, the analyzer unit 16 can communicate with the host computer 22 over telephone lines shared with other communication devices such as, for example, emergency telephones. As will be explained in more detail later, as the host computer 22 communicates with the analyzer unit 16, the host computer 22 receives information that can be displayed and stored in memory.

As further illustrated in FIG. 1, the host computer 22 can optionally communicate with a peripheral device 26. In the illustrated embodiment, the peripheral device 26 is another computer. The peripheral device 26 may be located in a fixed position, such as another building, another office, or a mobile location, such as a service vehicle (not shown). The host computer 22 communicates with the peripheral device 26 by sending a notification to the peripheral device 26 with information concerning the status of the selected circuit points 20 within the controller 14. In another embodiment, the peripheral device 26 could be any device, such as a cell phone, portable laptop computer, personal digital assistant, or pager, which is capable of receiving notifications from the host computer 22.

Figure 2:
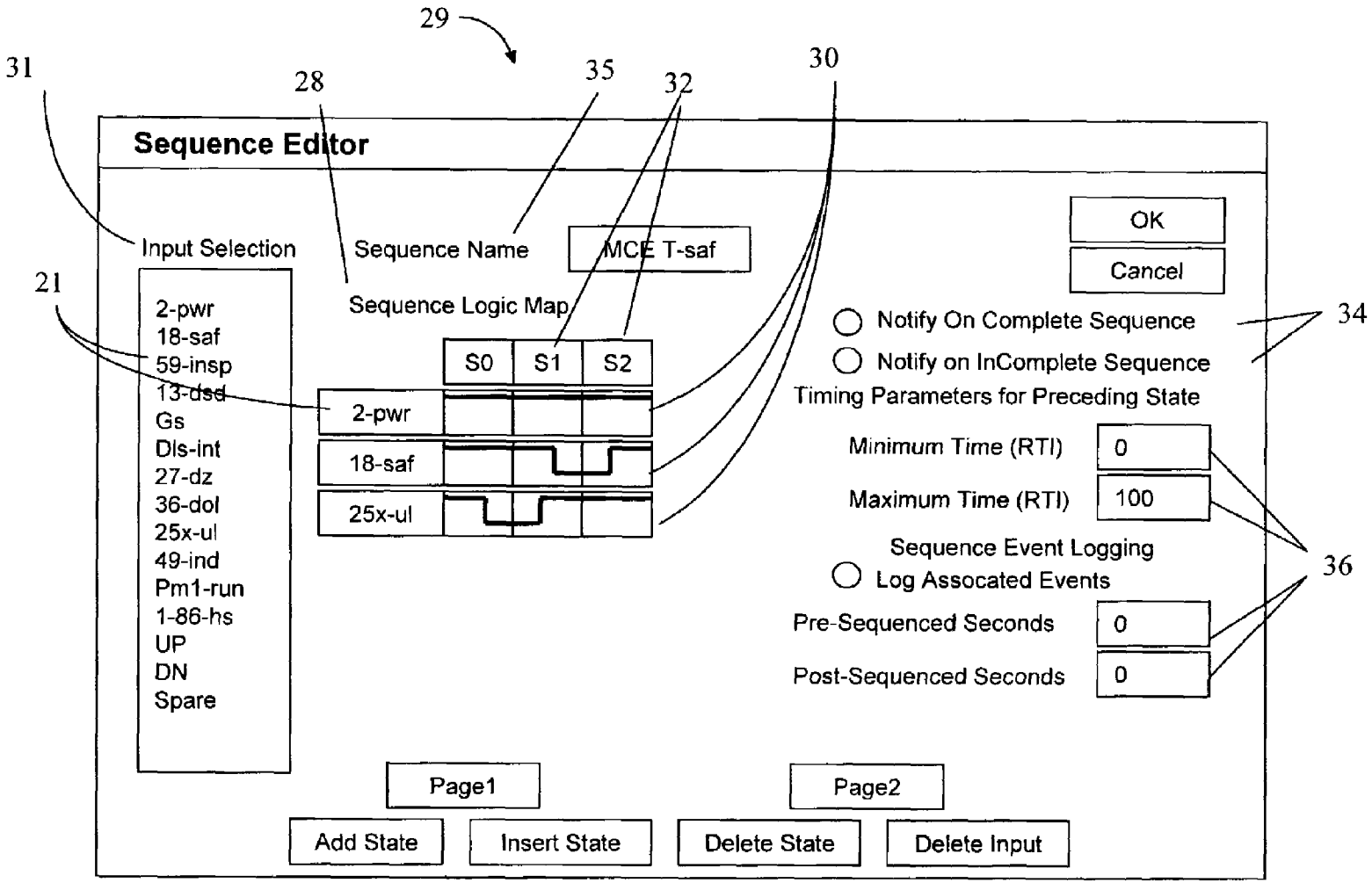
FIG. 2 illustrates a sequence editor provided with the diagnostic system of FIG. 1.

The host computer 22 includes software configured to perform several diagnostic system 10 functions. The first function of the host computer 22 is to configure the analyzer units 16. Each analyzer unit 16 is configured for the specific manufacturer, model, and type of transportation device. The second function of the host computer 22 is to configure each analyzer unit 16 for a user developed sequence logic map 28 using a Sequence Editor 29, such as shown in FIG. 2. In the illustrated embodiment, the Sequence Editor 29 is a graphical point and click interface that allows the user to enter selected circuit points 20 and their associated operating states. A sequence logic map 28 is a map listing the user selected circuit points 20 and a time-based sequence of state conditions 30 for each of the user selected circuit points 20. The sequence logic map 28 allows the user to configure any permutation and combination of selected circuit points 20 for analysis. The sequence logic map 28 describes any acceptable, unacceptable, and ignored behavior of the selected circuit points 20.

Figure 3:
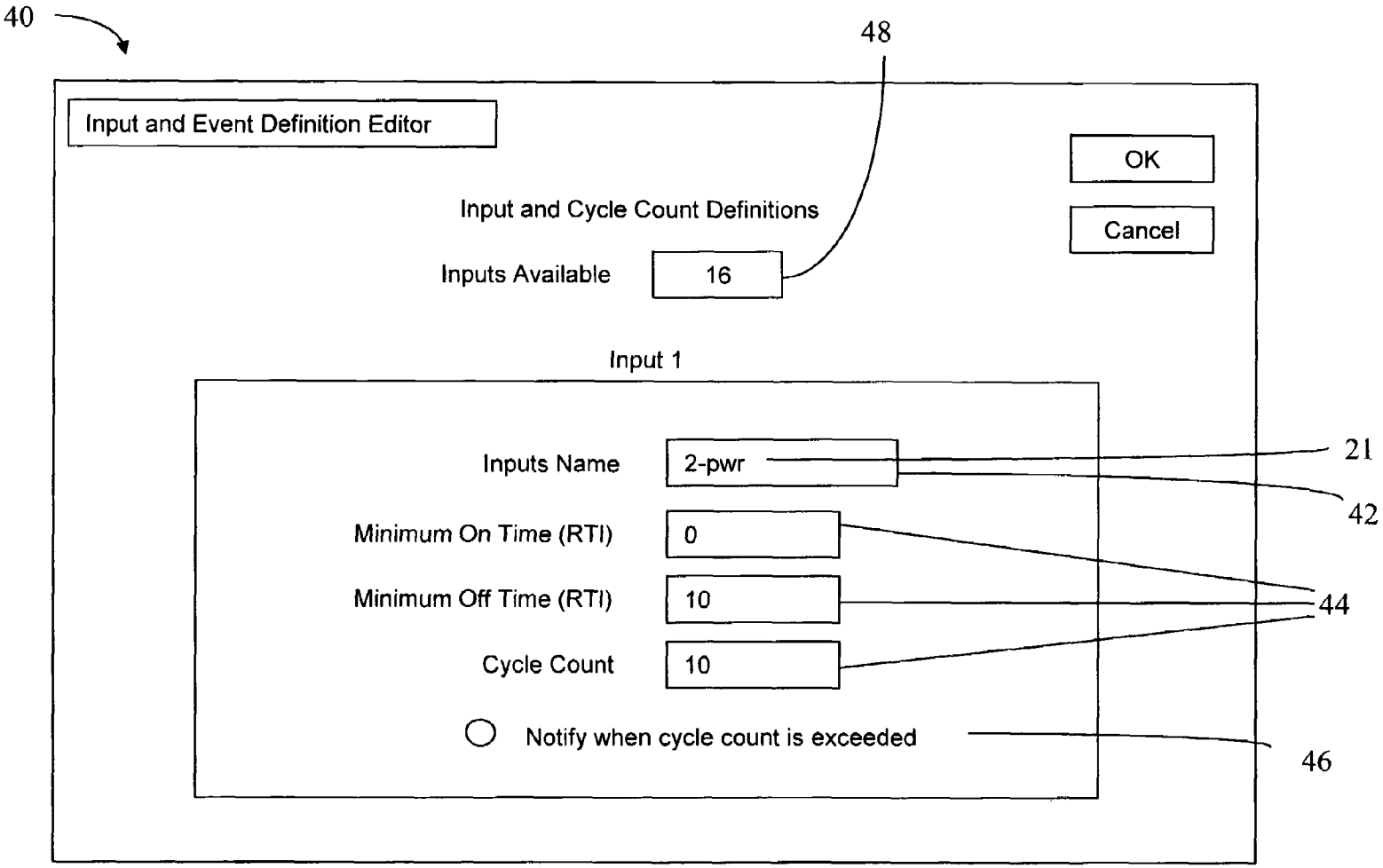
FIG. 3 illustrates an input and event definition editor provided with the diagnostic system of FIG. 1.

The sequence logic map 28 is configured by the user using an Input and Event Definition Editor 40, as shown in FIG. 3. In the illustrated embodiment, each user selected circuit point 20 is designated as a named input 21 by the user in the Inputs Name box 42. Each named input 21 is subsequently used in the sequence logic map 28 as shown in FIG. 2. Referring again to FIG. 3, the user sets initial operating conditions 44 for each named input 21, such as Minimum On Time, Minimum Off Time, and Cycle count. In addition, the user can select an initial cycle count notification function 46. The Input and Event Definition Editor 40 tracks the total number of named inputs 21 entered by the user and displays the remaining inputs available 48. In another embodiment, the user can enter additional information, such as for example voltage, normal on/off signal states, or high/low signal states for each of the named inputs 21.

Referring again to the Sequence Editor 29 as shown in FIG. 2, a list of the named inputs 21 is shown in the Input Selection 31. Each of the named inputs 21 are also listed in the Sequence Logic Map 28. The Sequence Logic Map 28 also includes sequential states 32 for each of the named inputs 21. A sequential state 32 is defined as the operation condition of a named input 21 at a given point in time. By analyzing the sequence 30 of the sequential states 32 for a named input 21, the user is better able to analyze a particular malfunction. The user adds as many sequential states 32 as needed to describe the sequence 30 to monitor the malfunctioning circuit. The user defines the sequence according to the sequential state 32, including the timing and the duration of the signal for each input name 21. The sequential state 32 can be defined as high or low, on or off, doesn't matter, or match else abort. The timing is defined as the time when a sequential state 32 for a particular named input 21 should be in a designated condition relative to signals for other named inputs 21. The duration is defined as the time a signal should be present or absent, how long the sequence 30 must be followed explicitly, and the time when a sequence 30 is compared. As an example, if the user wants to monitor the signals for two different named inputs 21 when both signals match the triggering conditions of the state sequence 32, the analyzer unit 16 compares the correct sequence states 32 and durations. If the correct sequence states 32 and durations are met, then the analyzer unit 16 generates a notification to inform the host computer 22 that the defined event(s) occurred. For purposes of clarity, the user can name each sequence 30 in the sequence logic map 28 using the Sequence Name input 35.

Using the Sequence Editor 29, the user is also able to set additional notification parameters 34, including notification on complete or incomplete sequencing. The user is also able to set additional sequential states 36 for each named input 21, including timing parameters, pre- and post-sequenced times.

Referring again to FIG. 1, as the transportation device operates and the analyzer unit 16 compares a stored sequence 30 with the operating values of an actual sequence, the analyzer unit 16 can sent a notification to the host computer 22. A notification is a message from the analyzer unit 16 to the host computer 22 that identifies the analyzer unit 16 and details the occurrence of the sequence comparison. In one embodiment, the notification includes the time that the sequence occurred, the name inputs 21 involved, and the various operating conditions and sequence states. Optionally, the user can configure the notification to include more or less information. In yet another embodiment, the user can also configure the analyzer unit 16 to notify the host computer 22 in the event the sequence 30 did not occur. Since the user has the flexibility to select any number of circuit points 20 and also has the flexibility to combine the selected circuit points 20 into any configuration of sequences 30, the diagnostic system 10 provides a highly flexible system capable of diagnosing even the most difficult or intermittent malfunctions.

Figure 4:
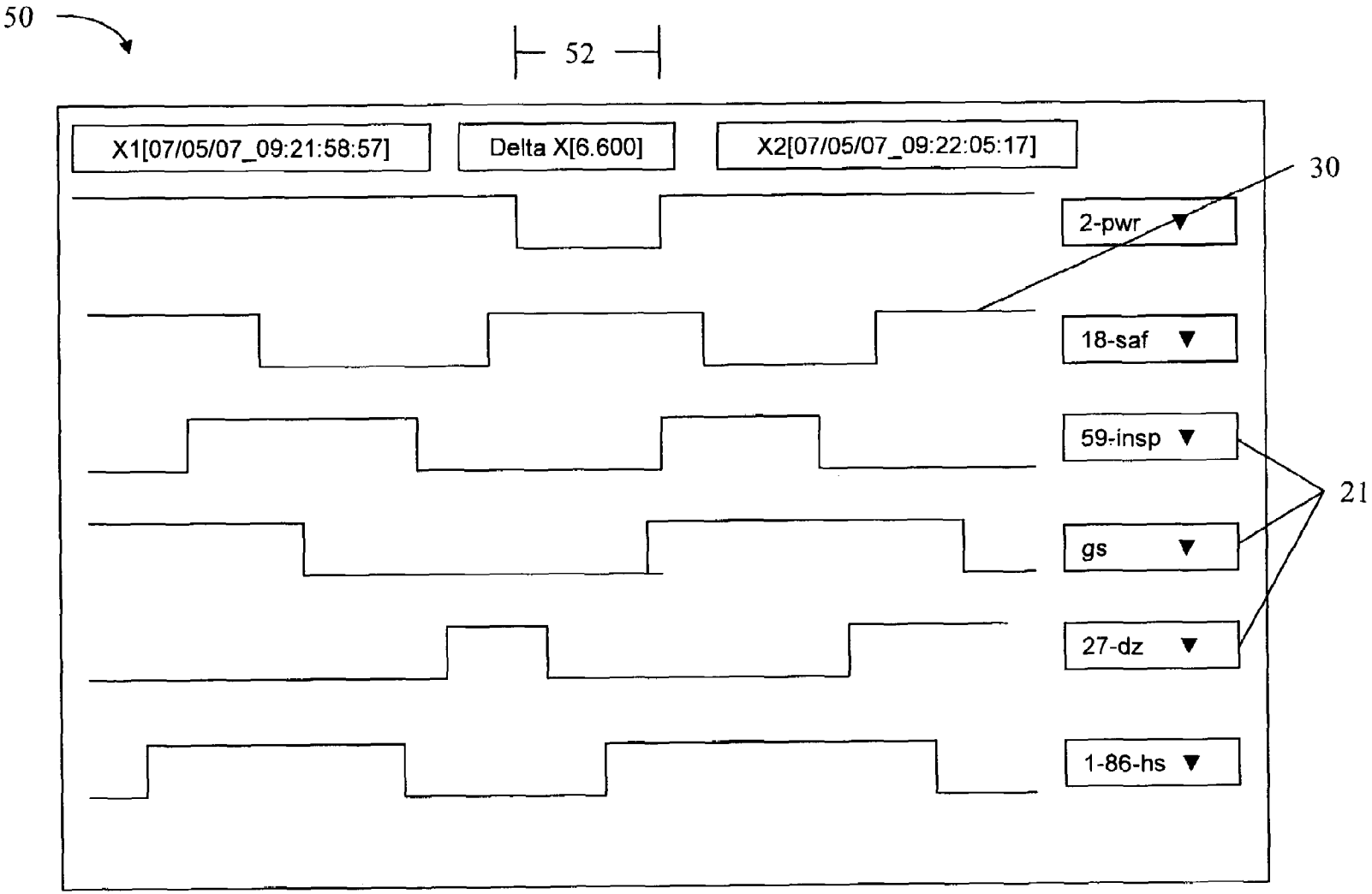
FIG. 4 illustrates an oscilloscope display provided with the diagnostic system of FIG. 4.

In addition to sending a notification to the host computer 22, the analyzer unit 16 can also provide additional information to the host computer 22. The additional information includes data displayed by the host computer 22 in the form of an oscilloscope type display 50, as shown in FIG. 4. The oscilloscope display 50 allows the user to view operating data for the named inputs 21 including signal durations 52 and the sequence of the state conditions 30 using a time-based reference. In one embodiment of the diagnostic system 10, the oscilloscope display 50 includes a display of data on a real-time basis. In another embodiment of the diagnostic system 10, the oscilloscope display 50 can display historical data. In yet another embodiment, while viewing real-time data, the oscilloscope display 50 can be paused to allow the user, to freeze the display 50 and study specific sequence 30 changes, while still allowing the user to record live data. While the oscilloscope display 50 is paused, the user can measure the duration 52 and amplitude between sequence changes 30 using a plurality of moveable cursors (not shown). The user also has the flexibility to change the time scale of the oscilloscope display 50 when viewing either live or historic data. Once the paused condition of the oscilloscope display 50 is turned off, the oscilloscope display 50 illustrates live data.

In another embodiment of the diagnostic system 10, the analyzer unit 16 can be equipped with a rechargeable battery back-up (not shown). The optional battery back-up allows the analyzer unit 16 to continue operation in the event the primary source of power to the analyzer unit 16 is interrupted. While operating on battery back-up, the analyzer unit 16 will continue to operate as previously described, including having the ability to send notifications of the power loss and will continue to record pre-determined operating information. In one embodiment of the diagnostic system 10, the rechargeable battery back-up is configured to provide power to the analyzer unit 16 for a period of time of up to approximately twenty-four hours. In another embodiment, the rechargeable battery back-up can provide power to the analyzer unit 16 for more than twenty-four hours. The rechargeable battery back-up ensures that the diagnostic system 10 will continue to function in the event of a power failure.

Referring again to FIG. 1, the host computer 22 is configured to store data communicated by the analyzer unit 16. The storage of the data is accomplished by a memory device (not shown) such as for example a hard drive, flash drive, or other suitable memory device. The memory device is configured for use in other computers (not shown). In another embodiment, the analyzer unit 16 can be configured to store data communicated to the host computer 22. In this embodiment, the analyzer unit 16 includes a memory device, such as for example hard drive, flash drive, or other suitable memory device.

Figure 5:
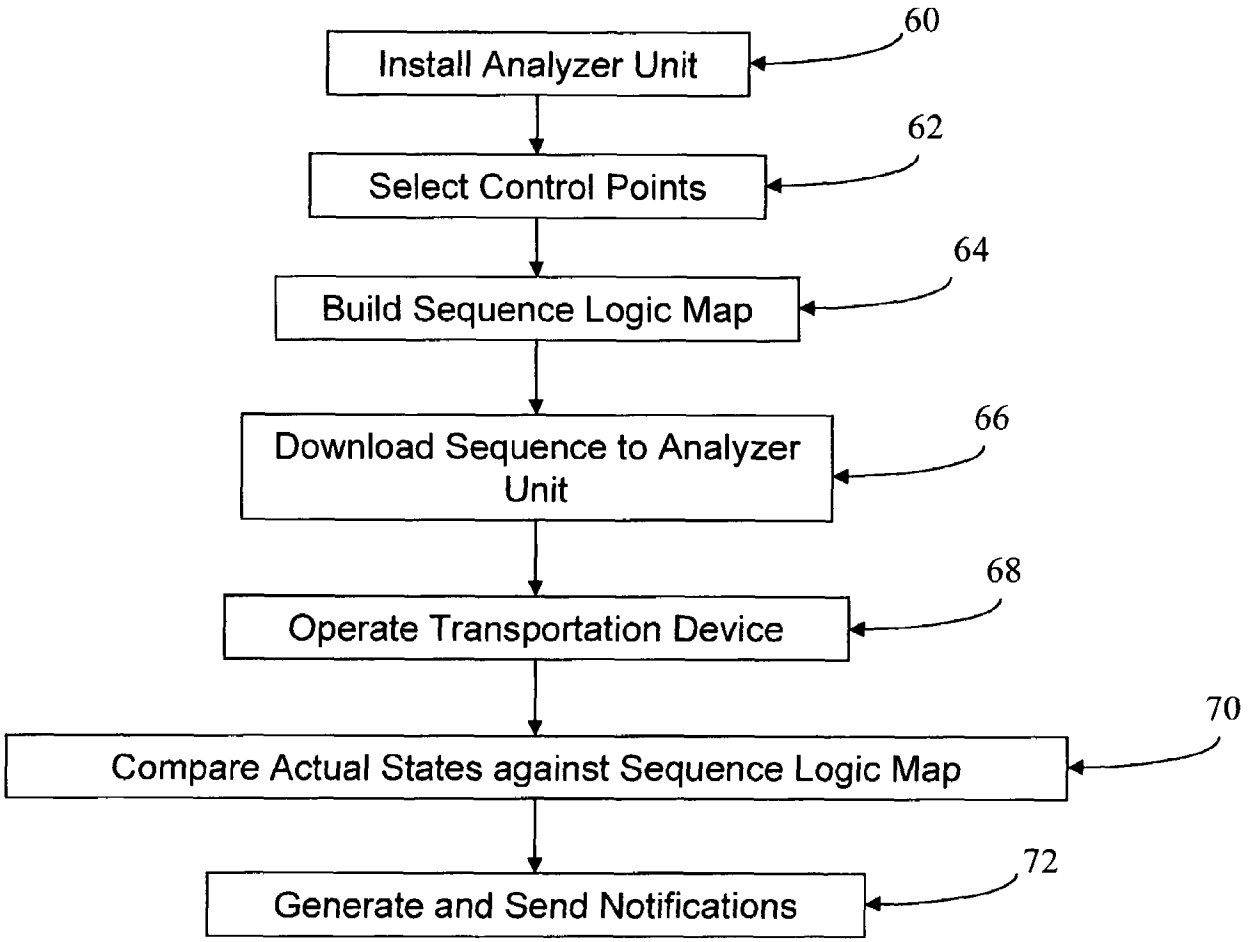
FIG. 5 illustrates a method of using the diagnostic system of FIG. 1.

FIG. 5 illustrates a method of using the diagnostic system of FIG. 1. As shown therein, the method begins with a step 60, wherein the user installs the analyzer unit 16 by attaching the analyzer unit 16 to the controller 14. Then, in a step 62, the user selects the circuit points to be monitored based on the malfunctions or problems to be corrected, the selected circuit points 20 are wired to the analyzer unit 16. Next, in a step 64, the user builds the sequence logic map 28 using the host computer 22. In a step 66, the user downloads the sequence logic map 28 and transportation device specific information to the analyzer unit 16. Next, in a step 68, the transportation device is operated in normal mode. In a step 70, data concerning the operating condition of the named inputs 21 is collected by the analyzer unit 16, the actual operating condition of the named inputs 21 is compared to the sequence logic map 28. In a final step 72, the analyzer unit 16 generates and communicates notifications to the host computer 22, wherein the notifications include the results of the comparison of the actual operating condition to the sequence logic map 28. Additional information, such as live oscilloscope data, is also communicated.

In accordance with the provisions of the patent statutes, the principle and mode of operation of this invention have been explained and illustrated in its preferred embodiments. However, it must be understood that this invention may be practiced otherwise than as specifically explained and illustrated without departing from its spirit or scope.

What is claimed is:

1. A diagnostic system for a transportation device comprising:

an analyzer unit connected to user selected circuit points within a transportation device controller, the analyzer unit including a user defined sequence logic map defining a sequence for a plurality of name inputs, the named inputs having operating conditions at given points in time pre-defined by the user, the analyzer being configured to monitor the condition of the plurality of named inputs during operation of the transportation device;

wherein the analyzer unit is configured to compare the operating condition of the plurality of named inputs with the user pre-defined sequence logic map and communicate the comparison in a notification.

2. The diagnostic system of claim 1 wherein the analyzer unit communicates the notification to a host computer.

3. The diagnostic system of claim 2 wherein the analyzer unit is connected to the host computer by a telephone line.

4. The diagnostic system of claim 2 wherein the host computer communicates with a peripheral device.

5. The diagnostic system of claim 1 wherein the transportation device is an elevator.

6. The diagnostic system of claim 1 wherein the analyzer unit is connected to the named inputs by electrical wiring.

7. The diagnostic system of claim 1 wherein the named inputs have a measurable voltage.

8. The diagnostic system of claim 1 wherein the named inputs generate an analog signal.

9. The diagnostic system of claim 1 wherein the sequence logic map describes acceptable, unacceptable and ignored behavior of the named inputs.

10. The diagnostic system of claim 1 wherein the notification includes data illustrated in an oscilloscope style display.

11. A method for diagnosing control system malfunctions, the method comprising the steps of:

selecting and naming a plurality of control system points;

providing an analyzer unit and connecting the analyzer unit to a transportation device controller, the analyzer unit including a user defined sequence logic map defining a sequence for the plurality of named control system points, the analyzer unit being configured to monitor the operating condition of the plurality of named control system points and communicate the comparison in a notification;

providing a host computer connected to the analyzer unit and configured to display the notification communicated by the analyzer unit;

pre-defining the operating conditions of the named control system points;

operating the control system;

collecting actual sequence data from the plurality of named control system points;

comparing the collected actual sequence data with the user pre-defined operating conditions of the named control system points in the sequence logic map; and communicating the results of the comparison in a notification to the host computer.

12. The method of claim 11 wherein the analyzer unit is connected to the host computer by a telephone line.

13. The method of claim 11 wherein the host computer communicates with a peripheral device.

14. The method of claim 11 wherein the transportation device is an elevator.

15. The method of claim 11 wherein the analyzer unit is connected to the named inputs by electrical wiring.

16. The method of claim 11 wherein the named inputs generate an analog signal.

17. The method of claim 11 wherein the sequence logic map describes acceptable, unacceptable and ignored behavior of the named inputs.

18. The method of claim 11 wherein the notification includes data illustrated in an oscilloscope style display.

19. The diagnostic system of claim 1, wherein the notification includes information of correct sequences and correct durations of the named inputs in the sequence logic map.

20. A diagnostic system for a group having two or more transportation devices, each transportation device having a controller, the diagnostic system comprising:

an analyzer unit attached to each controller of the transportation devices, the analyzer units being electrically connected to user selected circuit points within the attached controller, the analyzer units including a user defined sequence logic map defining a sequence for a plurality of name inputs, the named inputs having operating conditions at given points in time pre-defined by the user, the analyzer units being configured to monitor the condition of the plurality of named inputs during operation of the transportation devices; and a host computer electrically connected to the analyzer units;

wherein the analyzer units are configured to compare the operating condition of the plurality of named inputs with the user pre-defined sequence logic map and communicate the comparison in a notification to the host computer.

* * * * *